United States Patent [19]

Coombs

[11] Patent Number: 4,779,802

[45] Date of Patent: Oct. 25, 1988

[54] ATOMIZATION OF METALS

[75] Inventor: Jeffrey S. Coombs, West Glamorgan, Wales

[73] Assignee: Osprey Metals Limited, United Kingdom

[21] Appl. No.: 929,526

[22] Filed: Nov. 12, 1986

[30] Foreign Application Priority Data

Nov. 12, 1985 [GB] United Kingdom ..... 8527852

[51] Int. Cl.[4] ..... B05B 1/28

[52] U.S. Cl. ..... 239/292; 239/300; 164/46; 264/12

[58] Field of Search ..... 239/292, 293, 290, 295, 239/300, 301, 225.1, 226, 102.1, 264, 227; 164/46; 264/12

[56] References Cited

U.S. PATENT DOCUMENTS

| | | | |
|---|---|---|---|
| 2,738,231 | 3/1956 | Kurtz | 239/293 |
| 3,077,306 | 2/1963 | Herzog | 239/236 |
| 3,970,249 | 8/1976 | Singer | 239/102.1 |
| 4,064,295 | 12/1977 | Singer | 427/424 |

FOREIGN PATENT DOCUMENTS

| | | | |
|---|---|---|---|
| 808310 | 7/1951 | Fed. Rep. of Germany . | |
| 1625245 | 6/1970 | Fed. Rep. of Germany . | |
| 2043882 | 3/1971 | Fed. Rep. of Germany . | |
| 1389541 | 1/1965 | France | 239/290 |
| 2158964 | 6/1973 | France . | |
| 621457 | 8/1978 | U.S.S.R. | 264/12 |
| 2146662 | 4/1985 | United Kingdom . | |

*Primary Examiner*—Andres Kashnikow
*Assistant Examiner*—Karen B. Merritt
*Attorney, Agent, or Firm*—Roylance, Abrams, Berdo & Goodman

[57] ABSTRACT

A device for gas atomizing a liquid stream, such as a stream of molten metal or metal alloy, has an atomizing device including, for example, an annular opening for receiving the stream. The atomizing device is arranged for applying atomizing gas to the stream so as to form a spray of atomized particles. At least a part of the atomizing gas, and preferably all, is applied by means movable relative to the stream whereby movement is imparted to the spray. This movement leads to improved uniformity or control of deposition.

10 Claims, 5 Drawing Sheets

ATOMIZATION OF METALS

This invention relates to a device for gas atomising a liquid stream, such as a stream of molten metal or metal alloy.

The atomising and spray depositing of a stream of liquid metal has been known for many years, for example from British Patent Specification No. 1262471, and our own British Patent Specification Nos. 1379261 and 1472939. However, it has always been a problem to achieve precise control of the mass deposition in the metal on the deposition surface.

One proposal to improve the control of the mass distribution of the deposited layer of gas atomised of metal is set out in British Patent Specification No. 1455862 where it is proposed to oscillate the spray of atomised particles by the use of a primary set of gas jets for atomisation and two sets of secondary jets which are rapidly switched on and off to impart an oscillatory motion to the spray of atomised metal. However, it was found that the arrangement did not give ideal control of the mass distribution of the metal deposited. Therefore, an alternative proposal for imparting a direction to a spray was suggested as disclosed in European Patent Publication No. 0127303A. That arrangement involves the switching on and off of individual gas jets which accomplish the function of both atomising and oscillating the spray. However, both these methods are very difficult to control, and in particular lack flexibility in operation. In the first proposal the use of secondary jets can result in excess cooling of the deposited metal meaning that subsequently arriving particles do not coalesce properly with the already deposted metal. In the second method the shape and properties (e.g. temperature) of the spray can change as individual jets are switched on and off which makes it extremely difficult to ensure uniform deposition and solidification conditions.

An object of the present invention is to provide an improved device for gas atomizing a liquid stream, such as a stream of molten metal or metal alloy and for imparting controlled and precise movements to the atomised liquid stream.

According to the present invention a device for gas atomising a liquid stream such as a stream of molten metal or molten metal alloy, comprises an atomising device which, in use, is arranged to receive the stream and for directing atomising gas at the stream to form a spray of atomised particles wherein at least a part of the atomizing gas is supplied by means movable relative to the stream to impart movement to the spray. Preferably, the atomising device and the atomising gas means are movable together relative to the stream.

The invention also includes a method of moving a spray comprising positioning an atomising device for receiving a liquid stream such as a stream of molten metal or metal alloy, passing the liquid stream through the atomising device, atomising the stream by the application of atomisation gas from atomising gas means at the atomising device to form a spray of atomised particles, and moving at least a part of the atomising gas means relative to the stream during atomisation to impart movement to the spray.

The improved method of the present invention does not involve the switching on and off of gas jets to oscillate the spray. Instead, despite the proximity to the nozzle from which molten metal issues, we have devised a system whereby the spray is moved by moving the atomising jets themselves or the whole atomising device. This has the following particular advantages over previous method:

(a) on average the atomising conditions can be kept relatively constant because gas jets are not being switched on and off, i.e. the atomising conditions may be the same or otherwise controlled regardless of the degree of movement of the spray;

(b) the movement imparted is preferably an oscillation and the angle of oscillation can be changed very easily merely by increasing the angle of tilt of the whole or part of the atomiser during each cycle;

(c) the rate of oscillation can be easily varied; and (d) the speed of oscillation at any instant during each cycle of oscillation can be easily varied.

Consequently, the apparatus and method of the present invention provides a very high degree of control over the atomising device and the movement of the spray which previously has not been attainable. This enables the oscillation conditions to be varied to suit the shape of deposit being produced or to control the deposition conditions and/or the profile of the spray on the surface of the collector.

In one form of the method of the invention the liquid stream is molten metal or metal alloy, the spray is directed at a substrate moving continuously through the spray and the spray is moved transverse to the direction of movement to achieve uniformity of thickness of deposition across the width of the substrate whereby strip, coated strip, plate or coated plate products may be formed.

The invention will now be described by way of example with reference to the accompanying drawings in which.

Figure 1:
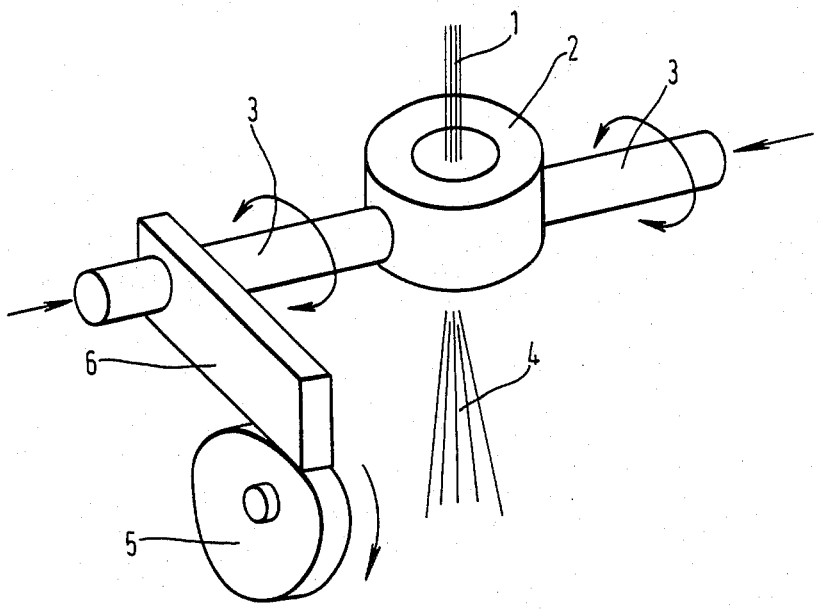
FIG. 1 is a perspective diagrammatic view of a preferred apparatus.

In FIG. 1 of the drawings a liquid stream 1, such as molten metal or metal alloy, is teemed through an atomising device 2. The device 2 is generally annular in shape and is supported by diametrically projecting supports 3. The supports 3 also serve to supply atomising gas to the atomising device in order to atomise the stream 1 into a spray 4. In order to impart movement to the spray 4 the projecting supports 3 are mounted in bearings (not shown in FIG. 1) so that the whole atomising device 2 is able to tilt about the axis defined by the projecting supports 3. The control of the tilting of the atomising device 2 comprises an eccentric cam 5 and a cam follower 6 connected to one of the supports 3 as will be explained. By altering the speed of rotation of the cam 5 the rate of oscillation of the atomising device 2 can be varied. In addition, by changing the surface profile of the cam 5, the speed of oscillation at any instant during the cycle of oscillation can be varied. The oscillation typically can be up to 30° from the stream axis although the movement may not necessarily be centered on the stream axis, this will depend upon the shape of the deposit being formed.

Figure 2:
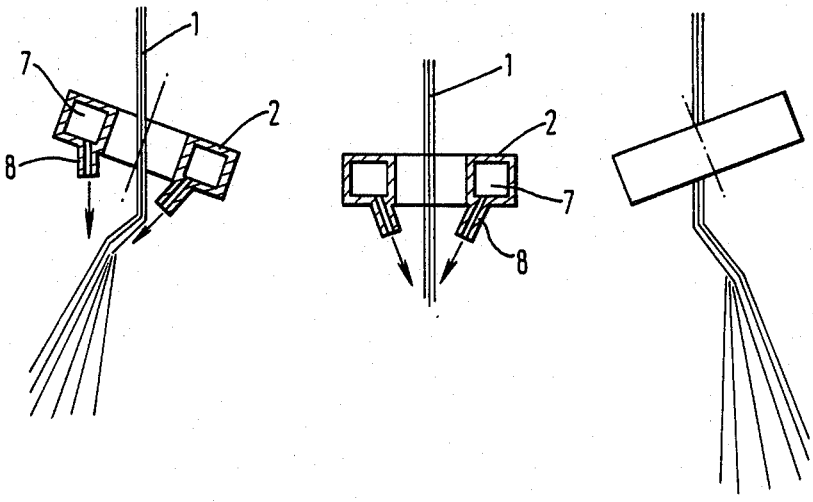
FIG. 2 illustrates diagrammatically the mode of movement of the atomising device and hence the movement imparted to a spray.

From FIG. 2 it can be seen that the atomising device 2 comprises a plenum chamber 7 and a plurality of gas atomising means consisting of nozzles 8. In the preferred embodiment the whole atomising device 2 is tiltable as indicated by FIG. 2 so that, as it is tilted the gas issuing from the nozzles 8 imparts lateral movement to the spray.

Figure 3:
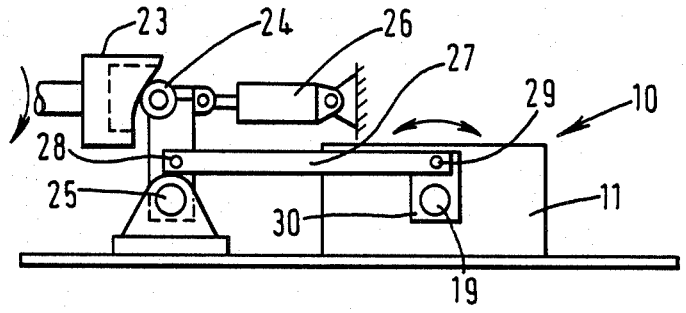
FIG. 3 is a plan and side elevation of a preferred atomiser.
Figure 3:
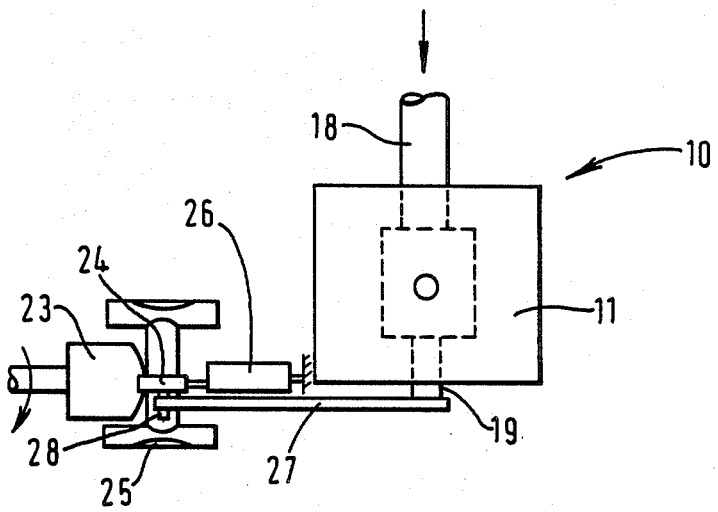
Figure 4:
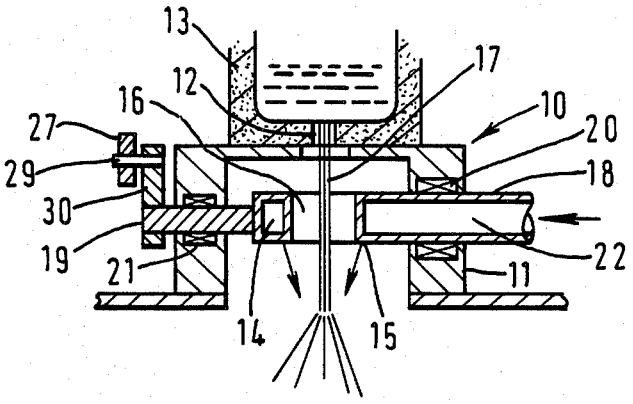
FIG. 4 is sectional side elevation of the atomiser.

FIGS. 3 and 4 illustrate a preferred embodiment of the invention in more detail. In those Figures an atomising device 10 is positioned within an atomiser housing 11 and below the nozzle opening 12 of tundish 13. The atomising device 10 includes a plenum chamber 14 and has atomising gas jet openings 15. The atomising device 10 is substantially annular in shape having a central opening 16 through which a stream 17 from the tundish 13 is arranged to pass. The atomising device is supported within the housing 11 by diametrically opposed supports 18, 19 which project outwardly from the atomising device 10 and is positioned sufficiently away from the bottom of the tundish 13 and has a central opening 16 dimensioned so that the atomising device may be made to undergo a tilting motion. So that this tilting motion may be achieved the supports 18, 19 are mounted within respective bearings 20, 21 in the atomiser housing 11. One of the supports 18, also serves as a conduit 22 to supply atomising gas to the plenum chamber 14.

The movement of the atomising device 10 is effected by mechanical means consisting of a drum cam 23 rotated by drive means (not shown) and, a cam follower 24 pivoted at 25 and held against the cam profile by means of a pneumatic cylinder 26. The cam follower 24 has a connecting arm 27 pivoted to it at 28 and the arm 27 extends to a further pivotal connection 29 on a plate 30. The plate 30 is freely movable and is fixed to the support 19, as clearly shown in FIG. 4, at a position offset from the pivotal connection 29.

Accordingly, it will be understood that movement of the drum cam 23 is translated into movement of the atomising device 10 via the cam follower 24, connecting arm 27 and plate 30. The cam profile may be designed to define a predetermined degree of movement and the speed of rotation of the drum cam, which may be readily controlled in a known manner by an electric motor, the speed of movement of the atomising device. Movement of the atomising device, suitably a to and fro oscillatory movement, imparts a corresponding movement to the spray since the atomising device 10 carries with it the atomising gas jet openings 15.

Figure 5:
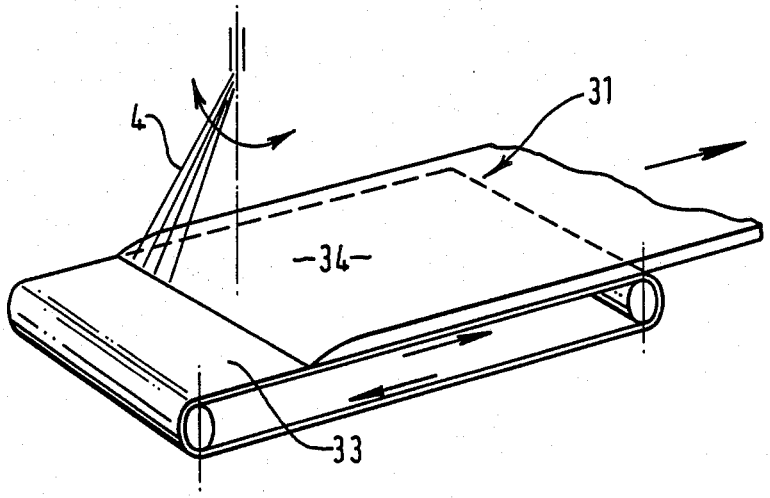
FIG. 5 is a diagrammatic perspective view of the invention as applied to the manufacture of strip.
Figure 6:
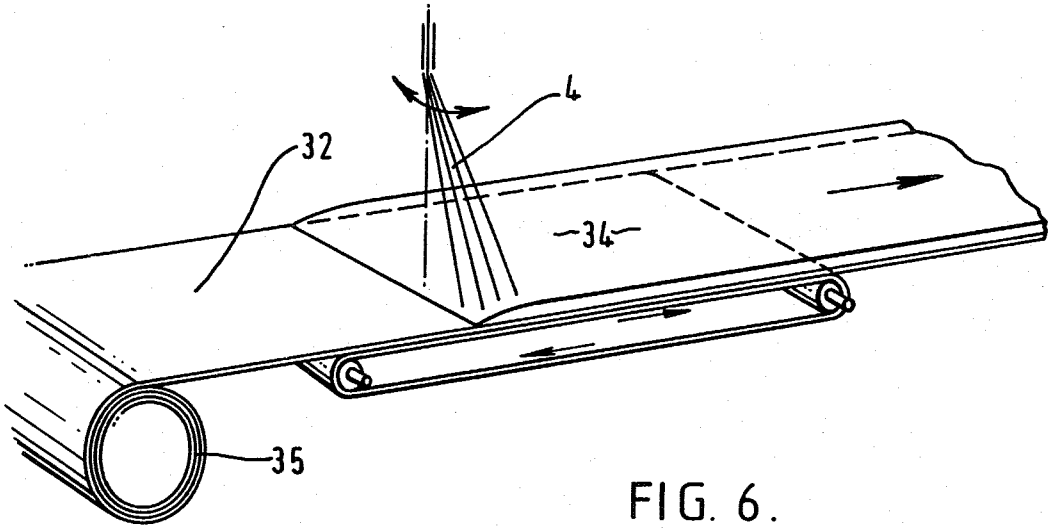
FIG. 6 is a diagrammatic perspective view of the invention as applied to the coating of strip.

The atomising device of the present invention is particularly useful for producing strip or plate 31 as illustrated in FIG. 5. Also, the apparatus may be used for producing spray coated strip or plate products 32 as shown in FIG. 6. In producing these products the spray is moved to and fro at right angles to the direction of movement of a collector 33 moving continuously through the spray as indicated by the arrows in the Figures. This ensure that the deposit 34 is formed uniformly across the width of the collector, or substrate, preferably in the thickness range 0.5 mm–50 mm. Preferably the substrate or collector will pass a plurality of atomising devices aligned along the axis of the movement of the substrate. In respect of coated strip or plate 31 the substrate to be coated may suitably be unwound from a decoiler 35 diagrammatically illustrated in FIG. 6. Although the present invention is particularly suitable for forming strip, plate and coated strip and plate it will be understood, that the atomiser can be used beneficially for producing many other products including ingots, bars, tubes, rings, rolls, conical shapes forging and extrusion blanks, spray coated products, laminates, composites, and products for thixotropic deformation etc. The substrate or collector may be an flat substrate, an endless belt or a rotatable mandrel.

The formation of strip will now be described by way of example:

EXAMPLE OF STRIP PRODUCTION:
WIDTH=300 mm

DEPOSITED MATERIAL—0.15% CARBON STEEL
POURING TEMP.—1580 degrees centigrade
METAL POURING NOZZLE—9.0 mm bore
SPRAY HEIGHT—630 mm (ie Distance from the underside of the atomiser to collector)
OSCILLATING SPEED—10 cycles/sec
OSCILLATING ANGLE—13° about a vertical axis
ATOMISING GAS—Nitrogen
COLLECTOR—0.5 mm thick×300 mm wide×1000 mm length mild steel plate-grit blasted.
COLLECTOR MOVEMENT—40 mm/sec
LIQUID METAL FLOW
RATE INTO ATOMISER—58 kg/min
GAS/METAL RATIO—0.3 Kg/Kg
DEPOSIT THICKNESS—8 mm STRIP PRODUCTION: WIDTH=155 mm
DEPOSITED METAL—0.15% CARBON STEEL
POURING TEMP.—570° Centigrade
METAL POURING NOZZLE—9.0 mm bore
SPRAY HEIGHT—630 mm
OSCILLATING ANGLE—±7 degrees about a vertical axis
OSCILLATING SPEED—10 cycles/sec
ATOMISING GAS—Nitrogen
COLLECTOR—0.5 mm×155 mm wide×1000 mm length mild steel plate
COLLECTOR MOVEMENT—60 mm/sec
LIQUID METAL FLOW RATE INTO ATOMISER—60 kg/min
GAS/METAL RATIO—0.35 Kg/Kg
DEPOSIT THICKNESS—10 mm In the present invention the spray cone generated by the atomising device is always maintained and the gas jets which, in prior inventions, were used to impart an oscilation to the spray, are used merely for atomisation.

Figure 7:
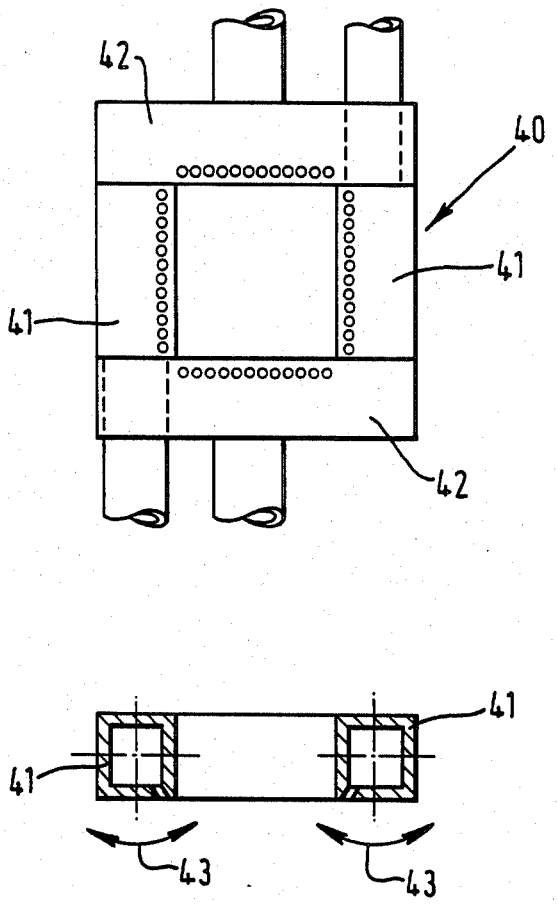
FIG. 7 is a diagrammatic view of an alternative atomising device where only part of the device is movable.

Not all the jets need necessarily be moved. For example in FIG. 7 an atomising device 40 is substantially square shaped in plan and comprises pairs of opposed atomising jets 41, 42. Atomising jets 41 are movable so as to move a spray, formed by passing a liquid stream through the centre of the device 40, in a to and fro direction indicated by arrow 43. However, opposed jets 42 are fixed to provide side curtains of gas which keep the oscillating spray within confined lateral limits. As an alternative the atomising gas means may simply be a single gas opening such as an annulus.

Whilst the invention has been particularly described with reference to the atomisation of liquid metal streams, the invention may be applicable to the atomisation of other liquid streams such as liquid ceramics or liquid stream or spray into which solid metallic or non-metallic particles or fibres are injected or incorporated. Also, whilst the present invention has been described with reference to mechanical control means, preferred methods for controlling the movement of the atomiser may be electro-mechanical means such as a programme controlled stepper motor, or hydraulic means such as a programme controlled electro-hydraulic servo mechanism using a linear actuator to control oscillation movement.

The above devices can also be used for producing gas atomised metal powders whereby the movement of the spray can impart improved cooling to the atomised particles.

I claim:

1. Apparatus for gas atomising a liquid stream, such as a stream of molten metal or metal alloy, and for controlling the mass distribution of a layer deposition from the atomised stream, the combination comprising:

an atomising device;

a plenum chamber forming a part of the atomising device and defining an opening through which the stream may be teemed;

atomising means communicating with the plenum chamber for forming an atomising gas flow field of predetermined geometry which atomises the stream into a spray of droplets; and means for moving the atomising device angularly about an axis and relative to the stream whereby the application of angular movement about said axis may impart an oscillation to the gas flow field and thereby to the spray with the geometry of the atomising gas flow field remaining substantially constant.

2. Apparatus according to claim 1 wherein the atomising device is annular and the atomising means comprises a plurality of atomising jets.

3. Apparatus according to claim 1 wherein the atomising device is annular and the atomising means comprises an annulus.

4. Apparatus according to claim 2, further comprising means for supporting the atomising device at diametrically opposed positions, the support means communicating with the plenum chamber with an atomising gas supply.

5. Apparatus according to claim 1, further comprising control means for controlling the moving means so as to move the atomising device through a predetermined cycle of movements.

6. Apparatus according to claim 5 wherein the control means comprises a movable cam and a cam follower connected to the atomising device and adapted to follow the movable cam.

7. Apparatus according to claim 5 wherein the control means comprises an electro-mechanical means including a stepper motor.

8. Apparatus according to claim 5 wherein the control means comprises hydraulic means including an electro-hydraulic servo mechanism.

9. Apparatus for gas atomising a stream and for controlling the deposition conditions of a deposit formed from deposition of the atomised stream, the combination comprising:

an annular atomising device;

an annular plenum chamber formed within the atomising device and having a central opening through which the stream may pass;

means coupled to the atomising device for supporting the atomising device including an inlet path communicating the plenum chamber with an atomising gas source;

a plurality of atomising gas jet openings formed in the plenum chamber for directing atomising gas onto the stream passing through the opening, the atomising gas jet openings being positioned in a predetermined fixed relationship relative to one another so as to form an atomising gas flow field of predetermined geometry; and means for moving the support means and the atomising device angularly about an axis passing through the support means whereby the angular movement about the axis imparts an oscillation to the gas flow field and to the spray with the geometry of the atomising gas flow field remaining substantially constant and whereby the shape and deposition conditions of a formed deposit are controlled.

10. Apparatus for controlling the mass distribution of a layer deposited on a surface by an atomised stream, the combination comprising:

a device for forming an atomising gas flow field of predetermined geometry which atomises the stream into a spray of droplets comprising a plenum chamber defining an opening through which the stream is teemed and atomising means including a nozzle in said plenum chamber for directing atomising gas toward the stream; and means for oscillating said plenum chamber about said stream whereby said nozzle oscillates about said stream and the atomising gas directed through said outlet causes the stream to oscillate.

* * * * *